United States Patent [19]

Heath

[11] 4,280,767

[45] Jul. 28, 1981

[54] PRINTING APPARATUS

[75] Inventor: John S. Heath, Winchester, England

[73] Assignee: International Business Machines Corporation, Armonk, N.Y.

[21] Appl. No.: 47,456

[22] Filed: Jun. 11, 1979

[30] Foreign Application Priority Data

Feb. 9, 1978 [GB] United Kingdom ..... 35407/78

[51] Int. Cl.[3] ..... B41J 35/14; B41J 35/18

[52] U.S. Cl. ..... 400/216.2; 400/216.3; 400/217; 400/213; 400/240.4

[58] Field of Search ..... 400/211, 213, 216, 216.2, 400/216.3, 216.5, 217, 217.1, 227, 240, 240.4

[56] References Cited

U.S. PATENT DOCUMENTS

| | | | |
|---|---|---|---|
| 1,273,302 | 7/1918 | Wright | 400/216.2 |
| 2,038,716 | 4/1936 | Christian | 400/216.2 |
| 2,048,188 | 7/1936 | Clarkson-Jones | 400/217 |
| 2,672,092 | 3/1954 | Beattie | 400/216 |
| 3,613,857 | 10/1971 | Thevis et al. | 400/217.1 |
| 3,811,547 | 5/1974 | Brearley | 400/217 |
| 3,897,865 | 8/1975 | Darwin et al. | 400/124 |
| 3,898,635 | 8/1975 | Kulterman | 340/196 |
| 3,993,181 | 11/1976 | Potma et al. | 400/217.1 |
| 4,096,578 | 6/1978 | Malkenes | 364/900 |
| 4,141,662 | 2/1979 | Hepper et al. | 400/216.2 |

FOREIGN PATENT DOCUMENTS

| | | | |
|---|---|---|---|
| 2019648 | 11/1971 | Fed. Rep. of Germany | 400/216 |
| 2743256 | 4/1979 | Fed. Rep. of Germany | 400/213 |

*Primary Examiner*—William Pieprz

*Attorney, Agent, or Firm*—John S. Gasper

[57] ABSTRACT

Printing apparatus, in particular for performing multicolor printing operations, has a ribbon shift mechanism for selectively interposing different transversely spaced portions of a print ribbon between a print head and platen. The print head is of the impact type and probably, although not necessarily, of the type which moves along the platen to define a print row. When color printing is required, a ribbon having a plurality of longitudinally extending stripes of different colors transversely spaced across its width is used. Selection of required portions or colors of the ribbon is performed by moving the head to pre-selected positions along the print row to engage, for example, a camming mechanism (including a cam and follower) which moves the shift mechanism the required amount to make the selection. Selection of the ribbon portion or color is by program control and in the case of color printing, the range of colors is increased by superimposed printing of the available colors on the print ribbon.

5 Claims, 5 Drawing Figures

PRINTING APPARATUS

BACKGROUND OF THE INVENTION

The invention relates to printing apparatus and particularly to printing apparatus of the type in which a print row is defined by relative movement between a single impact print head and a platen. That is, printing apparatus in which the print head either moves along the length of a fixed platen supporting a print receiving sheet to be impacted by the head or the platen carrying the paper sheet moves past a stationary print head. The sheet in both cases is incremented from one print row to another by a friction feed mechanism provided either in part by the platen itself or by a separate tractor feed mechanism engaging sprocket holes along the edges of the sheet. It is usual for printers fitted with tractor feed mechanism to be of the type in which the platen is stationary and the print head moves across the print row. A print ribbon positioned between the print head and the platen is supported by a ribbon feed mechanism which increments the ribbon during print operations in the usual manner. In some forms of apparatus the ribbon feed mechanism is mounted on the carrier supporting the print head. The ribbon may either be supplied on a supply spool which is placed on a receiving shaft with the ribbon manually theaded around ribbon guides to a take-up spool or, as is often the case with modern printers, supplied in a disposable cartridge which is merely loaded into a cartridge receptacle included on the print head carrier.

Typical of this type of printer apparatus is the so-called wire matrix printer which is of the moving head type and produces printed characters or images by means of a series of dots formed within a matrix. Many such matrix printers are commercially available, one example of which is the IBM 5103 printer. (IBM is a Registered Trade Mark of International Business Machines Corporation). Many other forms of impact printing apparatus of the traversing head type are to be found described in the literature or commercially available in the market place. Instead of the wire matrix print head other single element print heads such as the so-called "daisy-wheel" and "golf ball" print heads are used.

The growing use of colour displays has highlighted the need for a hard copy output device that can reproduce a multi-coloured screen image. Currently available colour printers utilizing ink jet or xerographic techniques, for example, tend to be expensive when compared with monochrome printers using matrix or other single element print heads. Accordingly, consideration has been given to ways of modifying existing relatively low cost monochrome printers to enable them to print multi-colour images. The limited resolution of present colour Cathode Ray Tube technology is well matched to the capabilities of wire matrix impact printer technology and this type of printer has been found particularly suited for such modification.

SUMMARY OF THE INVENTION

According to the invention, printing apparatus of the type described comprises a ribbon shift mechanism for selectively positioning different transversely spaced portions of a longitudinal print ribbon between a print element forming part of the print head and the platen, means operable in response to a location of the head at any one of a plurality of pre-selected print head positions along a print row to set the mechanism in an associated one of a corresponding plurality of different shift positions each of which interposes a different transversely spaced portion of the ribbon between the print element and the platen, and means for maintaining the mechanism set in a selected shift position during subsequent printing operations and for re-setting the mechanism prior to selection of a new shift position.

DETAILED DESCRIPTION OF THE INVENTION

In order that the invention may be fully understood, a preferred embodiment thereof will now be described with reference to, and as illustrated in, the accompanying drawings.

Figure 1:
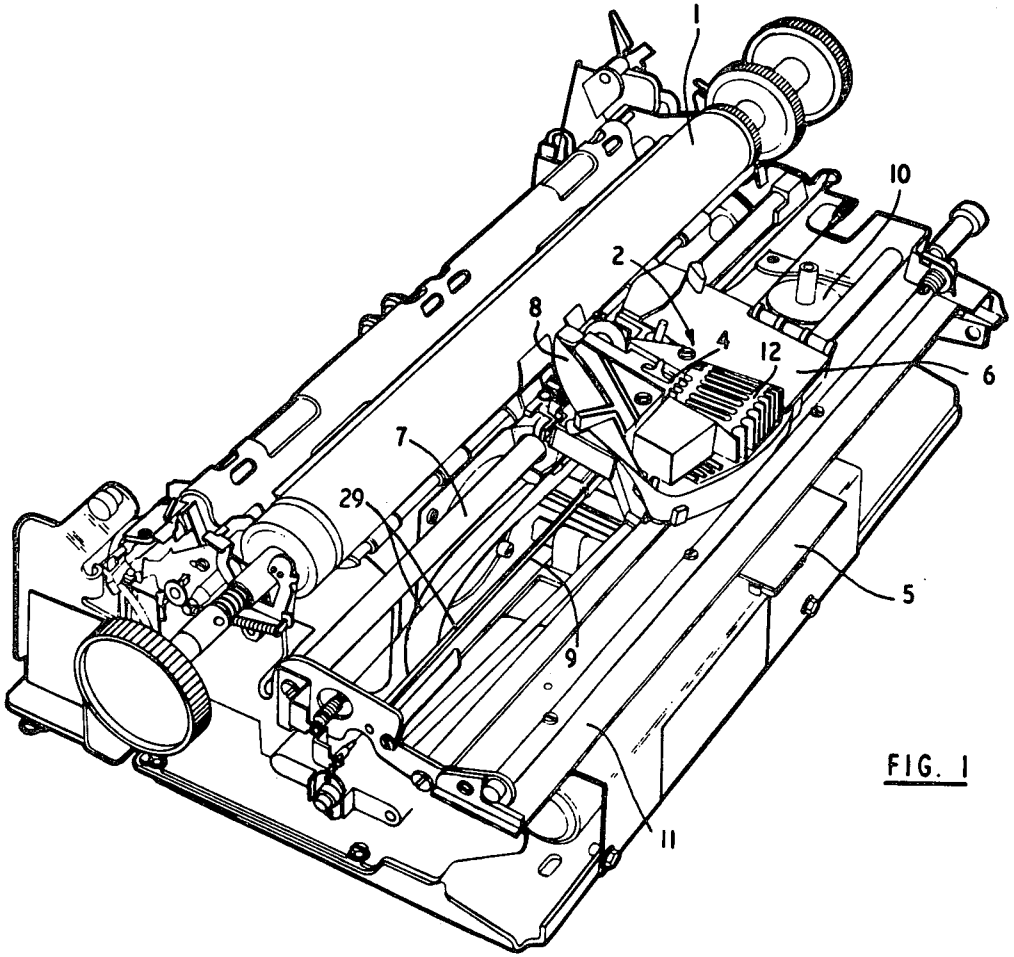
FIG. 1 shows a top perspective view of an IBM 5103 Printer.

As shown in FIG. 1, the basic printer mechanism is seen to consist of a typewriter platen 1 for supporting a paper sheet and a print head assembly, shown generally as 2, which moves horizontally along the platen to enable printing to be performed in rows on paper carried by the platen. The print head assembly 2 consists of a print head carrier 3 that supports and transports a print head 4, a print emitter pick-up 5, and ribbon transport and box 6 horizontally along the print row. The print head carrier is mounted for sliding motion on main shaft 7. The ribbon box 6 contains an inked fabric ribbon 8 provided in a continuous mobius loop. A ribbon feed mechanism forming part of the transport continuously moves the ribbon across the print head of the print head assembly whenever the print head carrier is in motion. The print head carrier is moved along the shaft 7 by a drive belt 9 coupled to a print head motor 10. Print head carrier movement slides the print emitter pickup 5 along a stationary print emitter 11 to produce print emitter pulses. These pulses are used to monitor print head movement along a print row and to control the timing of the printing operations. A description of the operation of a print emitter pickup and print emitter of the type used in the IBM 5103 Printer is to be found in U.S. Pat. No. 3,898,635 issued to R. W. Kulterman on Aug. 5, 1975.

The platen 1 is driven by a separate paper feed motor (not shown) and is adapted for friction feed of the paper and also for receiving and driving a tractor unit (not shown) when required for printing on continuous forms. A paper/forms feed emitter disk attached to the paper feed motor provides pulses indicating the rotational position of the platen. The pulses are also used to control paper/forms feed during printing.

The print head assembly 4 is enclosed in a print head box 12 in the figure and details of the print mechanism cannot be seen. The print head assembly, however, is of the wire matrix type and has eight vertically mounted print wires that produce dots on the paper by striking the inked fabric ribbon 8 against the paper. Some mechanical and operational details of a print head assembly of the type used in the IBM 5103 Printer are to be found in U.S. Pat. No. 3,897,865 issued to D. P. Darwin, et al on Aug. 5, 1975. The independent control of the paper feed and print head motors in principle enables dots to be printed in any position on the paper. Furthermore, with the mechanism very good registration of overprinted dots is possible.

In addition to the normal character sets based on an eight high seven wide dot pitch cell, the printer can print graphics and also half-tone images using digital half-toning techniques. The printer is particularly suited to graphics since all electromechanical functions of the mechanism can be put under program control. A description of a printer control is to be found in U.S. Pat. No. 4,096,758 issued to C. D. Malkemes on June 20, 1978. Finally a complete description of the IBM 5103 Printer is to be found in IBM 5103 Printer Maintenance Manual (Form No. SY31-0414).

The modification to the printer mechanism to enable it to operate as a multi-colour printer involves replacing the monochrome ribbon with a wide multi-colour ribbon, each colour of which is provided as a longitudinal stripe along the entire length of the ribbon, and adding a ribbon vertical shift mechanism to selectively bring the various colours into alignment with the print element of the print head. The ribbon shift mechanism is operated under program control and by overprinting using different colour stripes on the ribbon, in addition to the direct printing with the individual ribbon colours themselves, a wide range of different colours are available for colour graphics and colour image reproduction.

The operation of the vertical shift mechanism could be controlled by an electromagnetic actuator but in the preferred embodiment to be described the head carrier motion into the region of the right-hand margin of the paper is used in conjunction with a trip and cam arrangement to raise or lower the mechanism in order to select the appropriate colour stripe. The trip and cam arrangement is fixed to the carrier main shaft in place of the usual carrier stop. The function of the trip is to reset the vertical shift mechanism to a deselected position in which the ribbon is at its lowest position before the cam mechanism is engaged. The arrangement is such that in the deselected position, the uppermost colour stripe of the ribbon is located between the print element of the print head and the platen. Upon further carrier movement into the right-hand margin, the cam mechanism is engaged and the shift mechanism is progressively raised thereby positioning the other colour stripes on the ribbon in turn between the print element and platen. Accordingly, any required colour stripe can be selectively positioned between print element and platen for a subsequent printing operation in that colour simply by moving the carrier to the corresponding position along the main shaft. A detent mechanism forming part of the ribbon shift mechanism holds the ribbon in the selected position as the cam arrangement is disengaged as a result of movement of the carrier to the left, that is back towards the printing area. This detent mechanism maintains the ribbon in the selected position during all subsequent printing operations until a different colour is required. Selection of a different colour is achieved by moving the carrier once again past the deselect trip into the right-hand margin region to the horizontal carrier position corresponding to the vertical displacement of the ribbon caused by the cam arrangement required to locate the new colour stripe between the print element and platen. The detent mechanism operates as before to maintain the ribbon in this new position during subsequent print operations until the ribbon colour is once again changed by movement of the carrier into the right-hand margin region.

Figure 2:
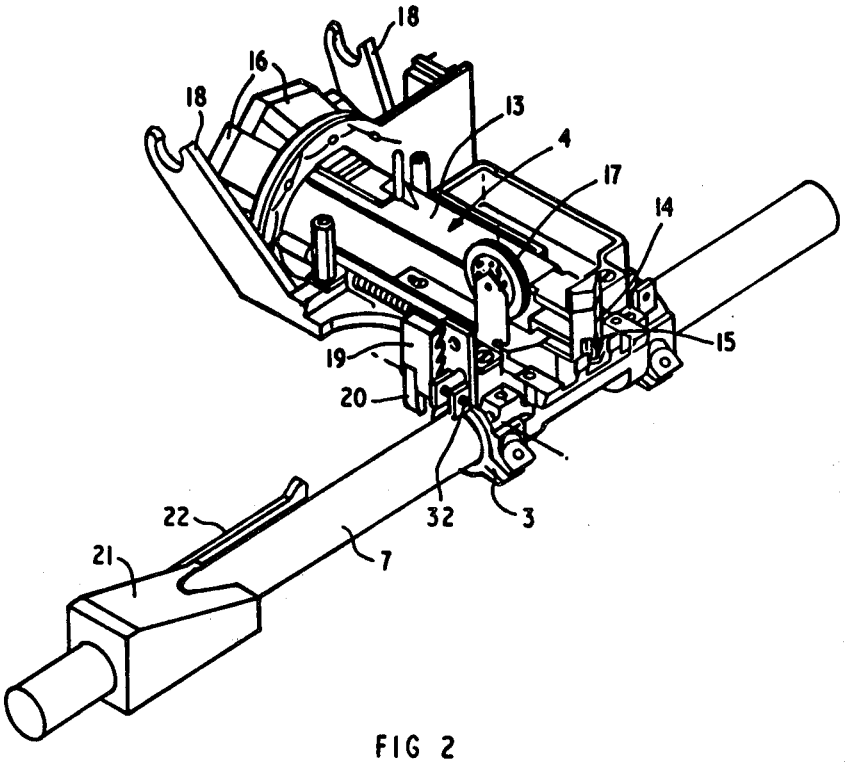
FIG. 2 shows a portion of the print head carrier assembly of the printer shown in FIG. 1, modified in accordance wih the present invention.

The preferred embodiment of the modified printer mechanism will now be described with reference to FIGS. 1 and 2. The same reference numerals will be used in these figures as in FIG. 1 to identify corresponding components. FIG. 2 shows the print head carrier 3 supported for lateral sliding motion on carrier main shaft 7. A wire matrix print head assembly 4, this time with print head cover removed, is rigidly secured to the carrier 3. The print head assembly 4 is of the type described in the aforesaid U.S. Pat. No. 3,897,865. Basically, eight print wires supported through the main body 13 of the assembly are grouped together at print head 14 in a closely spaced vertical line to form a print element 15. The wires are fanned out into a circle at their other ends and are driven by individually energizable armature assemblies 16, one for each print wire. Energization of an armature coil drives the associated armature forward and the impact surface at the end of the print wire attached thereto emerging from the print head 14 is driven against the ribbon. The print wire and armature are restored to their rest position by a return spring on termination of the energizing pulse. A copy control dial 17 on the print head adjusts the distance from the print head 14 to the platen to allow for the thickness of the paper/form receiving the print. Two ribbon transport trunions 18 extend from the carrier 3 to receive a multi-colour ribbon transport.

A detailed description of the print head mechanism and its operation is not required for an understanding of the present invention which can be effectively applied to any impact printer of the traversing head type. Further, as has already been mentioned, a more detailed description of the print head is to be found in the aforementioned reference manual and most details of construction and operation are additionally to be found in the U.S. Pat. No. 3,897,865. Accordingly, the brief description given above will not be expanded further.

The only modification to the carrier assembly is the provision of pivotally mounted detent ladder 19 and trip pawl 20 forming a portion of the ribbon shift mechanism pivotally attached to the carrier 3. The operation of this mechanism will be described later. A colour select cam 21 and detent trip 22 are secured to the carrier main shaft 7 at a position corresponding to the region of the right-hand margin of paper upon which printing is to occur. The function of this cam and trip arrangement will also be described later.

Figure 3:
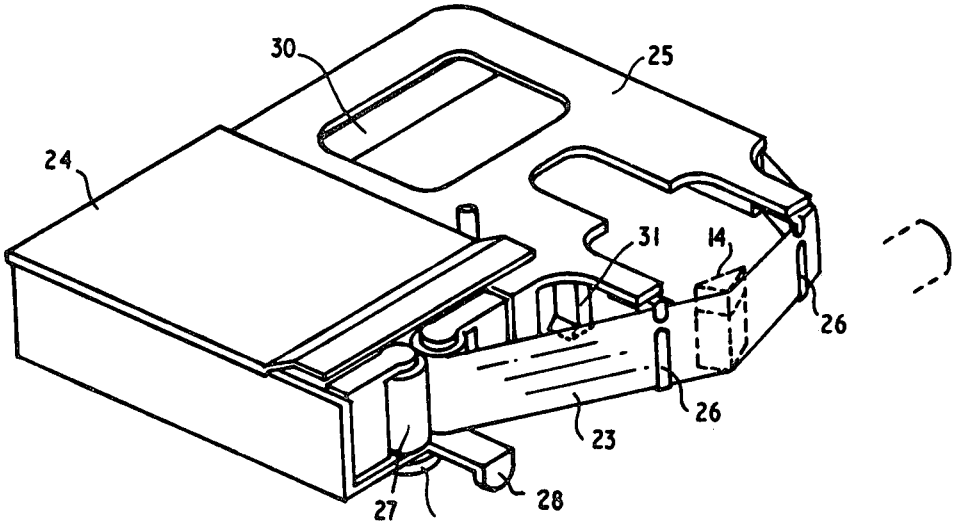
FIG. 3 shows a ribbon transport for use with the modified print head carrier assembly shown in FIG. 2.
Figure 3:
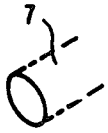

A ribbon transport for use in conjunction with the modified apparatus shown in FIG. 2 is itself shown in FIG. 3. The ribbon transport is similar to that shown in the unmodified apparatus of FIG. 1. Clearly, since the ribbon 23 has several longitudinal stripes of different colours transversely spaced across its width, it is not supplied as a mobius loop and accordingly the ribbon feed supports are different. Thus, the bulk of the multicolour horizontally striped ribbon 23 used in the modified apparatus is held as random convolutions in a rectangular stuff box 24. During use, the ribbon 23 is pulled from the stuff box 24, around a frame 25 carrying ribbon guide 26, and stuffed back into the stuff box 24 by ribbon feed rollers 27. Drive to the ribbon feed rollers 27 is provided by two capstans 27 (one only shown) engaging two tensioned strings 29 (FIG. 1) fixed to the printer machine frame. The capstans contain single direction clutches and the two strings are wrapped in opposite directions so that the ribbon feeds in a single direction for either direction of carrier motion. The mechanism is substantially the same as that used on the IBM 5103 Printer and fully described in the aforementioned manual, and since it has no direct bearing on the present invention no further description is required.

The main modifications to the ribbon transport are the provision of a pivot rod 30 provided across the inside back portion of the frame 25 enables the ribbon transport to be mounted on the carrier assembly shown in FIG. 2, a detent 31 forming a further portion of the aforementioned ribbon shift mechanism for co-operating with the detent ladder 19, and a cam follower 28 for co-operating with the colour select cam 21.

In use, the ribbon transport is loaded onto the carrier head assembly and held in place by the ribbon transport trunions 18, the open ends of which snap over the pivot rod 30. In this position the ribbon is held taut across the print head 14 (shown in dotted outline in FIG. 3) with the detent 31 engaging one of a number of detent teeth of detent ladder 19. Mounted in this manner, the ribbon transport may be tilted about the pivot rod 30 to interpose different portions of the ribbon 23 between the print element of the head 14 and the platen. There are as many detent positions as there are colour stripes on the ribbon, the positions being selected so that the ribbon transport may be held with any one of the colour stripes interposed between the print element of the head 14 and the platen 1. Rotation of the detent ladder 19 out of engagement with the detent 31 deselects the ribbon shift mechanism and the ribbon transport falls to its lowest position as previously described. The deselection is achieved by moving the carrier 3 to bring the detent trip pawl 20 into contact with the detent trip 22 by which it and the detent ladder are rotated about the supporting pivot 32. Further details of the detent ladder and pawl will be given later. A new colour stripe is selected by further movement of the carrier 3 to bring the cam follower 28 into contact with the surface of cam 21. Movement along the cam surface is continued so as to tilt the ribbon transport until the required colour stripe is selected.

Figure 4:
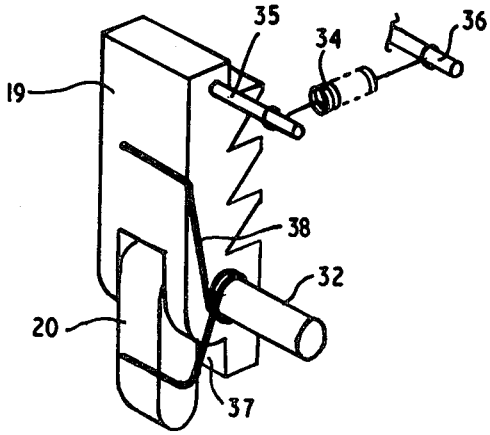
FIG. 4 shows in detail part of a ribbon shift mechanism attached to the modified carrier assembly shown in FIG. 2.

Details of construction of the portion of the ribbon shift mechanism attached to the carrier is shown in FIG. 4. As shown in the previous figure, the detent ladder 19 and trip pawl 20 are supported for rotation on pivot 32 extending from the carrier 3 (FIG. 2). A tension coil spring 34 is connected between a spigot 35 at the top of the detent ladder 19 and a similar spigot 36 on the carrier. This spring serves to maintain the ladder 19 and detent 31 in engagement during printing operations. A shoulder 37 at the lower end of the detent ladder 19 prevents relative rotational movement of pawl and detent ladder in one direction. A spring 38 supported on pivot 32 bears against detent ladder and pawl to hold them longitudinally aligned as shown in the figure. It will be seen therefore that movement of the trip pawl 20 into engagement with the trip 22 will cause rotation of pawl and ladder detent 19 about pivot 32 deselecting the mechanism. The inevitable contact of pawl and trip as the selected mechanism returns to the print position results in movement of the pawl 20 only about pivot 32 against the action of spring 38.

The ribbon in the preferred embodiment has four colour stripes, one of which is black. This combination enables printing to be performed in black and also in seven different colours. The seven different colours are obtained by using the three colours direct and also by mixing the colours by overprinting to produce four further colours. Clearly the number of colour stripes and selection of colours is largely a matter of design choice and many alternative selections are possible.

The ability to print a wide range of colours by superimposing three so-called primary colours is well established in the legitimate printing industry. Yellow, cyan and magenta plus optionally black, are used for all colour image printing because these colours enable the widest range of naturally occurring hues to be represented on paper.

The objective in the printing of alphanumerics and graphics in more than four colours is to obtain a wider range of distinguishable colours for clarification of complex data, to obtain more 'pleasing' graphics designs, and in particular to permit the direct representation or copying of CRT screens for which seven colours is a de-facto standard. It is very desirable that patterns of picture elements available in a screen buffer, or perhaps available from character set generators existing in the system should be usable directly in the printer. This makes it necessary that colour mixtures formed of equal and superimposed patterns of printed dots in all of the seven combinations of three colours should be both usable and distinguishable from each other. The three colours yellow, cyan and magenta are not a satisfactory set for two reasons. Firstly, yellow lines or characters on white paper have far too little contrast with the paper to be legible and secondly, there is not much perceived difference between magenta and its mixture with yellow. A set of colours which avoids these problems is light green, cyan and magenta. The light green can be formed by a mixture of yellow and cyan pigments or dyes.

Figure 5:
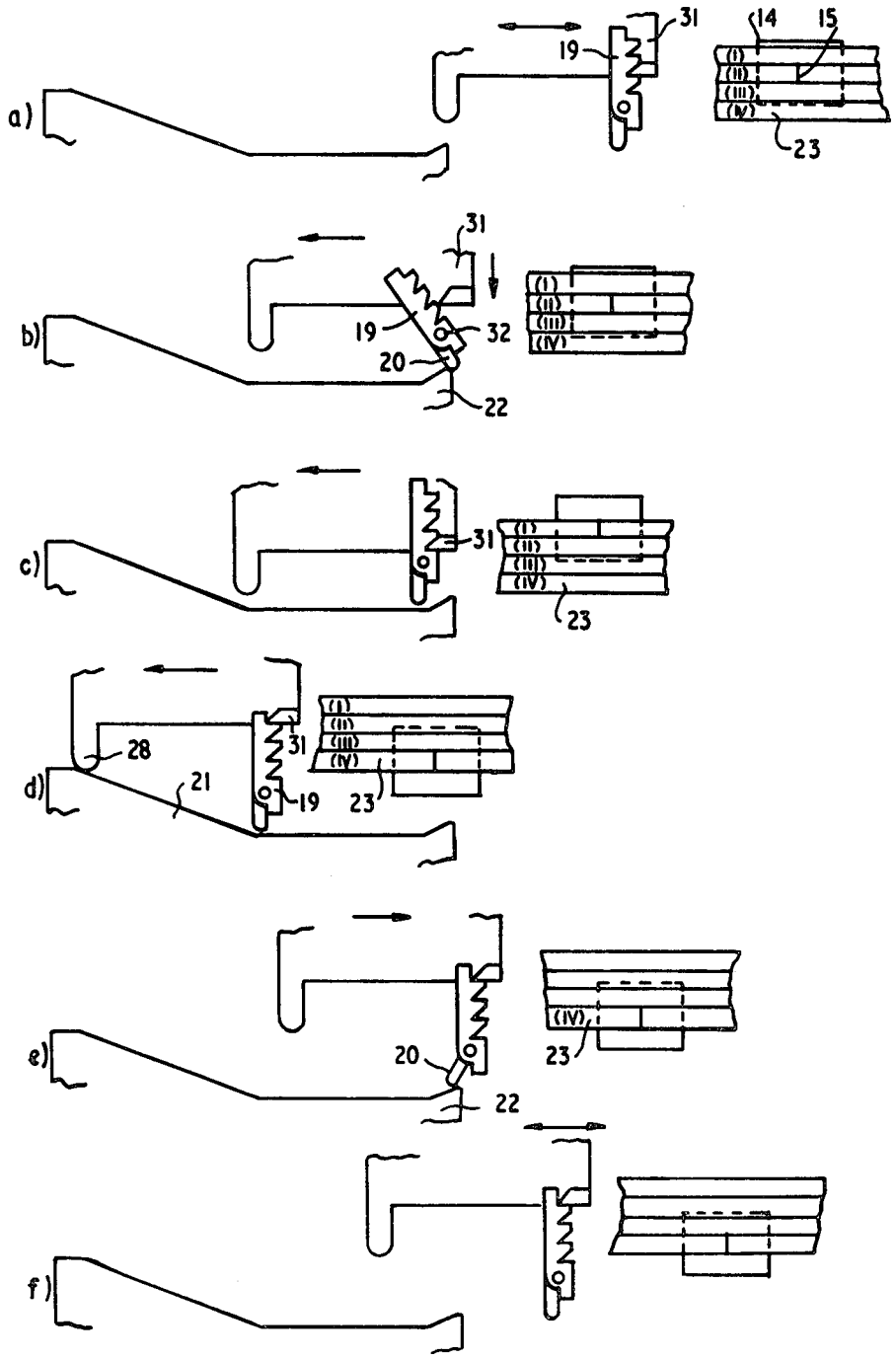
FIG. 5 shows the step-by-step colour selection operation with the modified printer mechanism.

In order to ensure that the operation and relative positions of the functional components of the modified printer according to the invention is fully understood, a step-by-step operation of colour stripe selection is shown in FIG. 5. The situation shown in the top view (a) of the figure shows ribbon shift mechanism with detent 31 latched in the second detent position of detent ladder 19 with the second stripe (ii) of the four stripe ribbon 23 interposed between the print element 15 of print head 14 and the platen (not shown). Printing with the colour of selected ribbon stripe (ii) is now possible.

The second view (b) of the figure shows the deselection of the ribbon shift mechanism prior to selection of a new color. The trip pawl 20 is in contact with the detent trip 22 and is being rotated about the pivot 32 by continued carrier movement. The detent ladder 19 is also rotated and the detent 31 released. The mechanism is thereby deselected and the ribbon shift mechanism falls to its lowest position.

The view (c) shows the situation after deselection of the ribbon shift mechanism. The detent 31 is in the first and lowest detent position with the first and top stripe (i) of the ribbon 23 selected for printing. Should this be the colour next required then the carrier would proceed no further but return to the print region.

The view (d) shows the selection of a new colour required for the next printing operation. The carrier has been moved to its extreme right-hand margin position. The cam follower 28 is at the top of the surface of cam 21 raising the shift mechanism until the fourth and bottom stripe (iv) of the ribbon 23 is selected. The detent 31 is latched in the fourth and highest detent position on detent ladder 19.

The view (e) of the figure shows the movement of the pawl 20 over the detent trip 22 as the carrier moves back towards the printing region. The ribbon shift mechanism remains unaffected by this movement and the strip (iv) of ribbon 23 remains selected. Finally, view (f) shows the shift mechanism once again in the print region with the required new colour selected.

The operation of the IBM 5103 is under program control of the using system, synchronised by means of the print emitter pulses. The pattern of dots to be printed is selected by the using system depending on the character desired. The print emitter pulses are used by the using system to time the print operation. The using system also supplies energizing pulses to the print head motor to move the print head left-to-right or right-to-left as required during the printing operations. The print emitter pulses supplied to the using system are used to monitor print head position. The system also supplied energizing pulses to the paper/form feed motor in closed loop mode using the output of the forms feed emitter to monitor the vertical position of the paper.

The setting of the ribbon shift mechanism to print in a selected colour is also performed by program control simply by adding a number of blank characters to a printed line, their position being such as to control carrier movement to the required place on the cam at which position the required colour stripe is automatically selected.

Although the preferred embodiment of the invention uses a wire matrix printer, it will be clear to persons skilled in the art that the invention is equally applicable to other forms of impact printers such as those using the so-called "daisy wheel" and "golf ball" print heads. Furthermore although output printers such as the IBM 5103 are of the type in which the platen is stationary and the print row is defined by a moving print head, the invention is equally applicable to printers where the head is stationary and the platen moves. Although the preferred embodiment is concerned with the vertical shifting of a colour striped ribbon in order to perform multi-colour printing operations, the invention has applications outside this field. For example, the apparatus subject of this invention could be effectively used simply for selection of different transversely displaced parts of a monochrome ribbon so as to make most efficient use of the entire printing surface of the ribbon. Accordingly, the appended claims have not been limited to apparatus for printing in colour.

Having thus described my invention, what I claim as new, and desire to secure by Letters Patent is:

1. Printing apparatus comprising a platen for supporting and feeding a print receiving document, an impact printing head mounted on a carrier for longitudinal movement along said platen to define a print row, a print ribbon feed assembly supported on said carrier adapted to support and feed a longitudinally striped multicolour ribbon between said printing head and said platen, the ribbon feed assembly being pivotally mounted on said carrier so as to be movable from a first tilt position into a plurality of predetermined other higher tilt positions all of which interposes a different colour stripe of said ribbon between the print element of the print head and the platen, a detent mechanism movable with said carrier and operable for supporting the ribbon feed assembly in any selected tilt position, a cam follower carried by said feed assembly, a fixed cam surface located at a first position along said print row beyond the point where printing is required so as to be engaged by said cam follower during movement of the print head along the print row beyond the point where printing is required, said cam surface and said cam follower coacting at said first position during movement of said carrier to lift said assembly through said plurality of tilt positions, a detent trip mechanism located at a second position along said print row beyond the point where printing is required in advance of said cam surface to contact and unlatch said detent mechanism during movement of said head to said second position for releasing said ribbon feed assembly for lowering from any of said higher tilt positions to said first tilt position, and control means for controlling movement of said carrier along said print row to enable printing operations to be performed in any selected colour along said print row where printing is required, said control means being operable for moving said carrier selectively to said first or second positions to select a tilt position of said ribbon feed assembly to enable subsequent printing to be performed in any selected colour.

2. Printing apparatus as claimed in claim 1 in which said ribbon feed assembly includes a frame on which, in use the print ribbon is supported with a section thereof interposed between said print head and platen in order to perform printing operations therewith, the frame being pivotally mounted on said carrier and movable with respect to the print head to enable said different colour stripes of the ribbon to be selectively positioned between the print element of the print head and the platen.

3. Printing apparatus as claimed in claim 2 in which said cam follower is connected to the frame and the construction and arrangement being such that movement of the frame about its pivotal mount is as a direct result of the camming action of said cam follower coacting with said cam surface.

4. Printing apparatus as claimed in claim 3, in which said detent mechanism includes a pawl and ratchet detent mechanism having a plurality of detent positions corresponding in number to the plurality of different tilt positions of said ribbon feed assembly, the detent mechanism being connected to said frame and arranged so that during cammed movement of the frame, the pawl moves freely along the ratchet successively from one detent position to the next, movement of the frame in the reverse direction being prevented by engagement of the first encountered one of said plurality of detent positions, the location of the detent positions being selected so that when engaged, each maintains the ribbon feed assembly in an associated one of said plurality of tilt positions.

5. Printing apparatus as claimed in claim 1 in which said control means further controls platen paper feed between printing operations, the platen feed being capable of feed forward and feed back movement in order to permit overprinting in different colours to be performed.

* * * * *